United States Patent [19]

Shichida

[11] Patent Number: 4,710,139

[45] Date of Patent: Dec. 1, 1987

[54] ELECTRICAL JACK ASSEMBLY

[75] Inventor: Akihito Shichida, Osaka, Japan

[73] Assignee: Hosiden Electronics Co. Ltd., Osaka, Japan

[21] Appl. No.: 864,041

[22] Filed: May 16, 1986

[30] Foreign Application Priority Data

Nov. 8, 1985 [JP] Japan ..... 60-171906[U]

[51] Int. Cl.[4] ..... H01R 17/18

[52] U.S. Cl. ..... 439/668; 439/743; 439/746

[58] Field of Search ..... 339/182, 183, 177 R, 339/177 E, 212, 217 S

[56] References Cited

U.S. PATENT DOCUMENTS

| | | | |
|---|---|---|---|
| 3,045,080 | 7/1962 | Frantz et al. | 339/183 |
| 4,493,526 | 1/1985 | Masuda | 339/183 |
| 4,609,242 | 9/1986 | Kemppainen | 339/177 R |

*Primary Examiner*—Gil Weidenfeld
*Assistant Examiner*—David Pirlot
*Attorney, Agent, or Firm*—Pollock, Vande Sande and Priddy

[57] ABSTRACT

A jack is composed of a body, a contact piece holder mounted on the body, and a contact piece mounted on the contact piece holder. The body is molded in a single piece by die casting of a conductive material and includes as integral portions of the body a cylindrical portion for receiving a plug, a flange extending from the cylindrical portion, and a terminal and a holding portion provided on the flange. The contact piece holder is carried by the holding portion of the die cast body. The contact piece holder can be mounted on the holding portion with a single operation, and the contact piece can also be mounted on the contact piece holder with a single operation.

9 Claims, 2 Drawing Figures

ELECTRICAL JACK ASSEMBLY

BACKGROUND OF THE INVENTION

The present invention relates to a jack which is provided with a contact piece for making electrical and mechanical connection with a plug which is inserted into the jack.

Conventionally, the manufacture of jacks of this general type involves the steps of fastening a terminal, by staking, to a metal cylindrical member having a through hole for receiving a plug, securing the cylindrical member to a body of an insulating material, and attaching a contact piece to the body. The conventional jacks thus need at least these four parts, and their assembly takes much time and labor.

It is therefore an object of the present invention to provide a jack which has fewer parts and hence is easier to assemble than is conventional for prior art jacks.

SUMMARY OF THE INVENTION

In accordance with the present invention, a cylindrical portion having a bore for receiving a plug, a flange extending about the periphery of the rear end of the cylindrical portion, a holding portion disposed on the flange on the opposite side from the cylindrical portion, and a terminal extending from the flange, are integrally molded through die casting of a conductive material. A contact piece holder of an insulating material, carrying a contact piece, is fitted into the holding portion. The contact piece makes resilient contact with the plug which is inserted into the cylindrical portion.

As described above, according to the present invention, the cylindrical portion, the flange, the terminal, and the holding portion are all formed as a unitary structure with one another. Accordingly, the jack of the present invention calls for only three parts, that is, the unitary-structured body, the contact piece holder, and the contact piece; the assembly of the jack is very easy and requires few manufacturing operations.

DESCRIPTION OF THE PREFERRED EMBODIMENT

Figure 1:
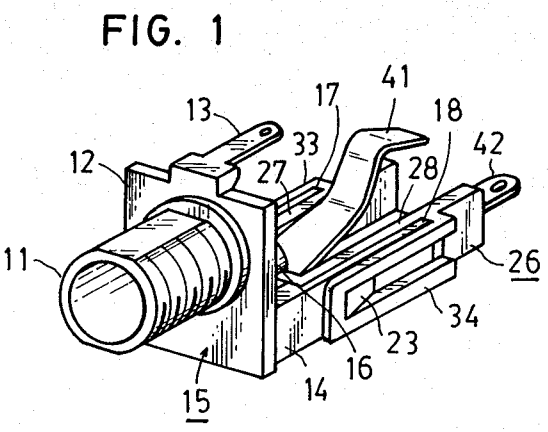
FIG. 1 is a perspective view illustrating an example of the jack of the present invention.
Figure 2:
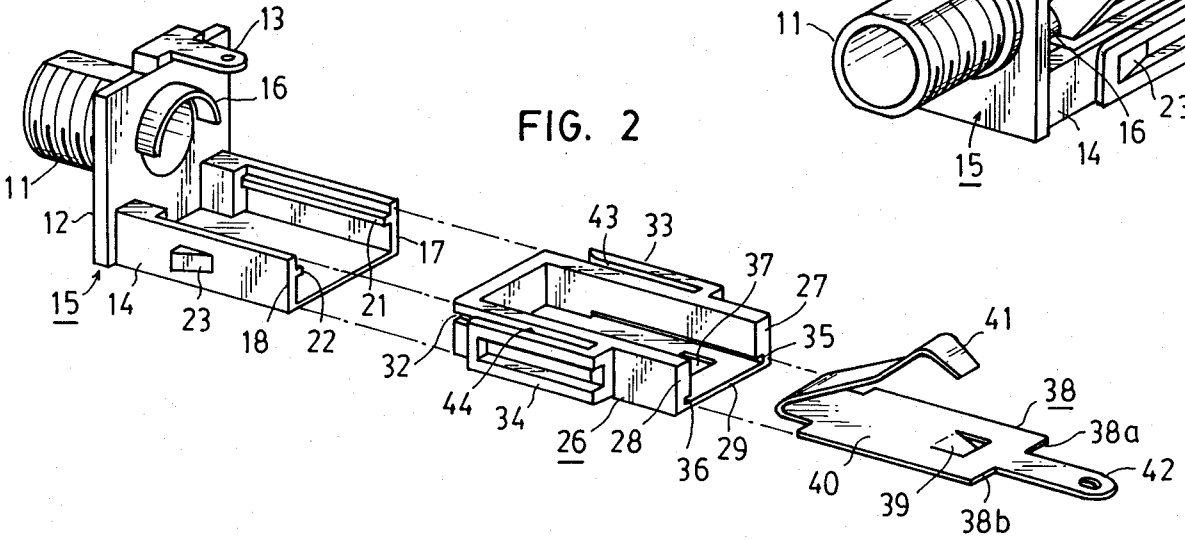
FIG. 2 is its disassembled perspective view.

As depicted in FIGS. 1 and 2, a cylindrical portion 11 having a through hole for receiving thereinto a plug has a flange 12 which extends from the periphery of the cylindrical portion 11 at the rear end thereof. In this embodiment, the flange 12 is square-shaped and has a terminal 13 which extends rearwardly from the upper edge of the flange 12 centrally thereof. Furthermore, a holding portion 14 extends rearwardly from the back of the flange 12 at the lower end portion thereof. The cylindrical portion 11, the flange 12, the terminal 13, and the holding portion 14 are all integrally molded as one body 15 by die casting of zinc, aluminum, or like metal. As illustrated in FIGS. 1 and 2, a semi-cylindrical portion 16 corresponding to the upper half of the cylindrical portion 11 may be protrusively formed on the back of the flange 12. The outer and inner peripheral surfaces of the cylindrical portion 11 may be plated with, for instance, nickel to enhance conductivity, corrosion resistance, appearance, etc.

The holding portion 14 has, in this example, a shallow box-like configuration, with its top and rear faces removed. On the opposed inner surfaces of left and right side panels 17 and 18 of the holding portion 14 there are protrusively provided rails 21 and 22 extending lengthwise thereof (in the direction in which the plug is forced into and out of the cylindrical portion 11). The side panels 17 and 18 have wedge-shaped lugs 23 and 24 on their outer surfaces (the lug 24 being not seen in the drawings).

A contact piece holder 26, formed by molding of an insulating material, is fitted into the holding portion 14. The contact piece holder 26 also has a shallow box-like configuration, open at the top and rear thereof. Its side panels 27 and 28 have in their outer surfaces elongated guide grooves 31 and 32, which extend rearwardly from the front ends of the side panels for receiving the rails 21 and 22 of the holding portion 14, respectively (the groove 31 being not neet in the drawings). Moreover, the side panels 27 and 28 have on their outer surfaces U-shaped engaging pieces 33 and 34 extending forwardly and defining slots 43 and 44 between the side panels 27, 28 and the engaging pieces 33, 34. When the contact piece holder 26 is assembled with the holding portion 14, the side panels 17 and 18 of portion 14 are held in the slots 43 and 44 of holder 26, respectively, and the engaging pieces 33 and 34 of holder 26 are engaged with the lugs 22 and 23 of portion 14, respectively. That is to say, the contact piece holder 26 can be mounted on the holding portion 14 by a single operation of pushing the contact piece holder 26 into the holding portion 14 from its open end portion, with the rails 21 and 22 fitted in the elongated grooves 31 and 32. This side panels 27 and 28 of the contact piece holder 26 have cut in their inner surfaces grooves 35 and 36 which extend forwardly of their rear ends along the bottom panel 29 of the holder 26. The bottom panel 29 of the holder 26 has a square hole or recess 37 made in its backward portion centrally thereof.

A contact piece 38 is carried by the contact piece holder 26. The contact piece 38 is formed by bending a shaped strip of resilient sheet metal into substantially a V-shape. One half of the V-shaped contact piece 38 acts as a mounting portion 40, and its two side margins 38*a* and 38*b* are engaged with and guided by the grooves 35 and 36. The contact piece 38 is inserted into the contact piece holder 26 from its rear open end portion until a downward engaging piece 39 of the mounting portion 40 is locked into the hold 37 of the contact piece holder 26. The free end portion of the other half of the contact piece 38 serves as a contact portion 41 and is positioned above but near the axis of the cylindrical portion 11 so that it makes resilient contact with the tip of a plug which is inserted into the cylindrical portion 11. The mounting portion 40 of the contact piece 38 has a terminal 42 which extends from its rear edge in a manner to project out rearwardly of the holding portion 14 when the jack is assembled.

As described above, the jack of the present invention comprises the body 15, the contact piece holder 26, and the contact piece 38, and hence has fewer parts than do the conventional jacks. The mounting of the contact holder 26 on the holding portion 14 and the mounting of the contact piece 38 on the contact piece holder 26 can each be accomplished with a single operation. Accordingly, the jack of the present invention is very easy to assemble.

Incidentally, it is also possible to extend the terminal 13 downward from the lower edge of the flange 12 and to bend the terminal 42 downward. Furthermore, it is also possible to employ a contact piece holder that is formed of a square tube in which a plurality of contact pieces are provided so that they make or break contact with or from one another as the plug is inserted into or pulled out of the cylindrical portion 11, or they individually make contact with a ring contact and an earth contact of the plug. Moreover, it is also possible to form the holding portion 14 such that the side panels 17 and 18 vertically extend along the opposite edges of the flange 12, so that the contact piece holder 26 with an aperture formed in the bottom panel 29 correspondingly to the cylindrical portion 11 can be slid into the holding portion 14 in parallel with the flange 12. In this case, the contact piece 38 may have an L-shape rather than the V-shape.

It will be apparent that many modifications and variations may be effected without departing from the scope of the novel concepts of the present invention.

What is claimed is:

1. A plug comprising:

a single die cast body of conductive material which integrates a cylindrical portion having a through hole for receiving a plug, a flange at one end of the cylindrical portion, said cylindrical portion extending away from one face of said flange, a terminal extending outwardly of the flange, and a holding portion extending away from another face of the flange opposite to said one face, said holding portion of said die cast body having a pair of opposed side panels on both sides of the cylindrical portion of said die cast body, said side panels extending away from said flange along said holding portion and in parallel relation to said holding portion in a direction opposite to the direction of extension of the cylindrical portion;

a contact piece holder fabricated of an insulating material, said contact piece holder being fitted into said holding portion of said die cast body, in slidable engagement with said side panels of said holding portion, from an open end of said holding portion remote from said cylindrical portion;

locking means between said holding portion of said die cast body and said contact piece holder for locking said holding portion to said contact piece holder as said contact piece holder is slidably fitted into said holding portion; and a contact piece carried by said contact piece holder for making contact with a plug inserted into the cylindrical portion of said die cast body, the contact piece being fabricated of a conductive material and having a terminal integrally formed therewith.

2. A jack according to claim 1 wherein a semicylindrical portion which lies on substantially the same cylindrical plane as the inner peripheral surface of the cylindrical portion is integrally formed with the flange in opposed relation to the contact piece holder.

3. A jack according to claim 1 wherein the locking means comprises lugs integrally formed on the outer surfaces of the holding portion of said die cast body, and engaging pieces coupled at one end with the outer surfaces of the contact piece holder and extending along said outer surfaces in adjacent but spaced relation thereto, the engaging pieces being in engagement with said lugs and respectively holding the side panels of the holding portion between said engaging pieces and the corresponding outer surfaces of the contact piece holder.

4. A jack according to claim 3 wherein engaging means is provided for engaging said contact piece holder with the holding portion of said die cast body, said engaging means comprising elongated grooves in the outer surfaces of the contact piece holder and extending lengthwise thereof, and rails protruding outwardly from the inner surfaces of the holding portion and extending lengthwise thereof in a manner to be fitted into the grooves, respectively.

5. A jack according to claim 3 wherein the lugs are formed on the outer surfaces of the side panels of the holding portion, each of the engaging pieces being U-shaped in cross section and integrally coupled at one end thereof with the contact piece holder, each engaging piece holding one of the side panels of the holding portion between it and the contact piece holder, and a U-shaped bent portion formed at the forward end of the engaging piece being engaged with the corresponding lug.

6. A jack according to claim 5 wherein engaging means is provided for engaging said contact piece holder with the holding portion of said die cast body, said engaging means comprising rails protrusively provided on the inner surfaces of the side panels of the holding portion and extending lengthwise thereof, and elongated grooves in the side surfaces of the contact piece holder and extending lengthwise thereof for receiving the rails.

7. A jack according to claim 1 wherein the contact piece is V-shaped and comprises two portions which are joined together at an apex of said V-shaped piece and extend angularly away from one another from said apex, said contact piece being mounted on the contact piece holder, one of said portions of said Vshaped contact piece being held in contact with the bottom of the contact piece holder and with the apex of the V-shaped contact piece being positioned adjacent the cylindrical portion of said die cast body so that the other said portion of the contact piece extends rearwardly from said apex in a manner to cross the axis of the cylindrical portion aslant.

8. A jack according to claim 7 wherein the opposing edges of said one portion of the contact piece are inserted into and held in grooves made in the inner surfaces of the contact piece holder and extending lengthwise thereof.

9. A jack according to claim 8 wherein locking means is provided which comprises a locking piece provided on said one portion of the contact piece and a hole made in the bottom of the contact piece holder for receiving the locking piece.

* * * * *